US006154968A

United States Patent [19]

Andre

[11] Patent Number: 6,154,968

[45] Date of Patent: Dec. 5, 2000

[54] COMPACT VIEWING FRAME FOR ARTISTS

[76] Inventor: Patti Andre, 3108 Birmingham Dr., Ft. Collins, Colo. 80526

[21] Appl. No.: 09/264,476

[22] Filed: Mar. 8, 1999

Related U.S. Application Data

[60] Provisional application No. 60/087,298, May 29, 1998.

[51] Int. Cl.[7] ..... B43L 5/60

[52] U.S. Cl. ..... 33/1 K; 40/709

[58] Field of Search ..... 40/765, 766, 491; 33/1 K, 1 BB, 297, 298, 20.3

[56] References Cited

U.S. PATENT DOCUMENTS

| | | | |
|---|---|---|---|
| 216,460 | 6/1879 | Rosquist | 33/20.3 |
| 223,569 | 1/1880 | White | 40/491 |
| 822,633 | 6/1906 | Schrick | 40/765 |
| 2,193,518 | 3/1940 | Lubin | 33/1 K |
| 2,881,544 | 4/1959 | Knox | 40/765 |
| 5,247,744 | 9/1993 | Ferris et al. | 40/765 |

FOREIGN PATENT DOCUMENTS

| | | | |
|---|---|---|---|
| 2190885 | 12/1987 | United Kingdom | 33/1 K |

*Primary Examiner*—Cassandra H. Davis
*Attorney, Agent, or Firm*—Dean P. Edmundson

[57] ABSTRACT

A compact viewing frame is described for use by artists to change the size and shape of viewed subject area. The viewing frame includes an opaque frame having a central opening, and an opaque panel which is slidable within the frame to change the size and shape of the opening in the frame. By moving the panel inwardly and outwardly relative to the frame, the artist can easily determine the most desirable composition of the subject to be painted, sketched, etc. It can also be used by photographers or cinematographers.

5 Claims, 4 Drawing Sheets

COMPACT VIEWING FRAME FOR ARTISTS

CROSS-REFERENCE TO RELATED APPLICATION

This application is based upon, and claims priority from, My provisional application Ser. No. 60/087,298, filed May 29, 1998.

FIELD OF THE INVENTION

This invention relates to devices and techniques for use by artists in framing a subject.

BACKGROUND OF THE INVENTION

When artists prepare to sketch or paint a subject, whether it be a landscape, natural object, or even a person, they desire to "frame" the subject to see how it would look. Framing a subject involves blocking out undesired objects and changing the dimensions of the viewed area (e.g., square, rectangular, vertical, horizontal, etc.) to determine the best composition of the subject in the eyes of the artist.

In order to "frame" a subject being viewed, an artist often uses his or her fingers to block out undesired objects. Sometimes an artist will use an empty photographic slide holder as a frame to block out undesired areas. However, these techniques are cumbersome and are not at all convenient.

There has not heretofore been provided a compact viewing frame having the features and advantages described herein.

SUMMARY OF THE INVENTION

In accordance with the present invention there is provided a compact viewing frame comprising:

(a) an opaque frame including a central opening therethrough (which is preferably square); and (b) an opaque panel carried by the frame and being slidably movable in a manner such that (i) when the panel is in an inward position the central opening of the frame is completely blocked by the panel, (ii) when the panel is in a fully-outward position the central opening of the frame is completely open, and (iii) when the panel moves between its inward and outward positions the shape and size of the central opening changes.

By using the viewing frame of the invention, an artist is able to quickly and easily change the size and shape of viewed subject area. By moving the sliding panel inwardly and outwardly relative to the frame, the size and shape of the viewed area is readily changed so that an artist can easily and simply determine the most desirable composition of the subject to be painted, sketched, etc. It can also be used by photographers or cinematographers.

The viewing frame can be made in various sizes and may be composed of metal, plastic, wood, cardboard, etc. The compact size enables the viewing frame to be easily carried in a pocket.

Other advantages of the viewing frame will be apparent from the following detailed description and the accompanying drawings.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
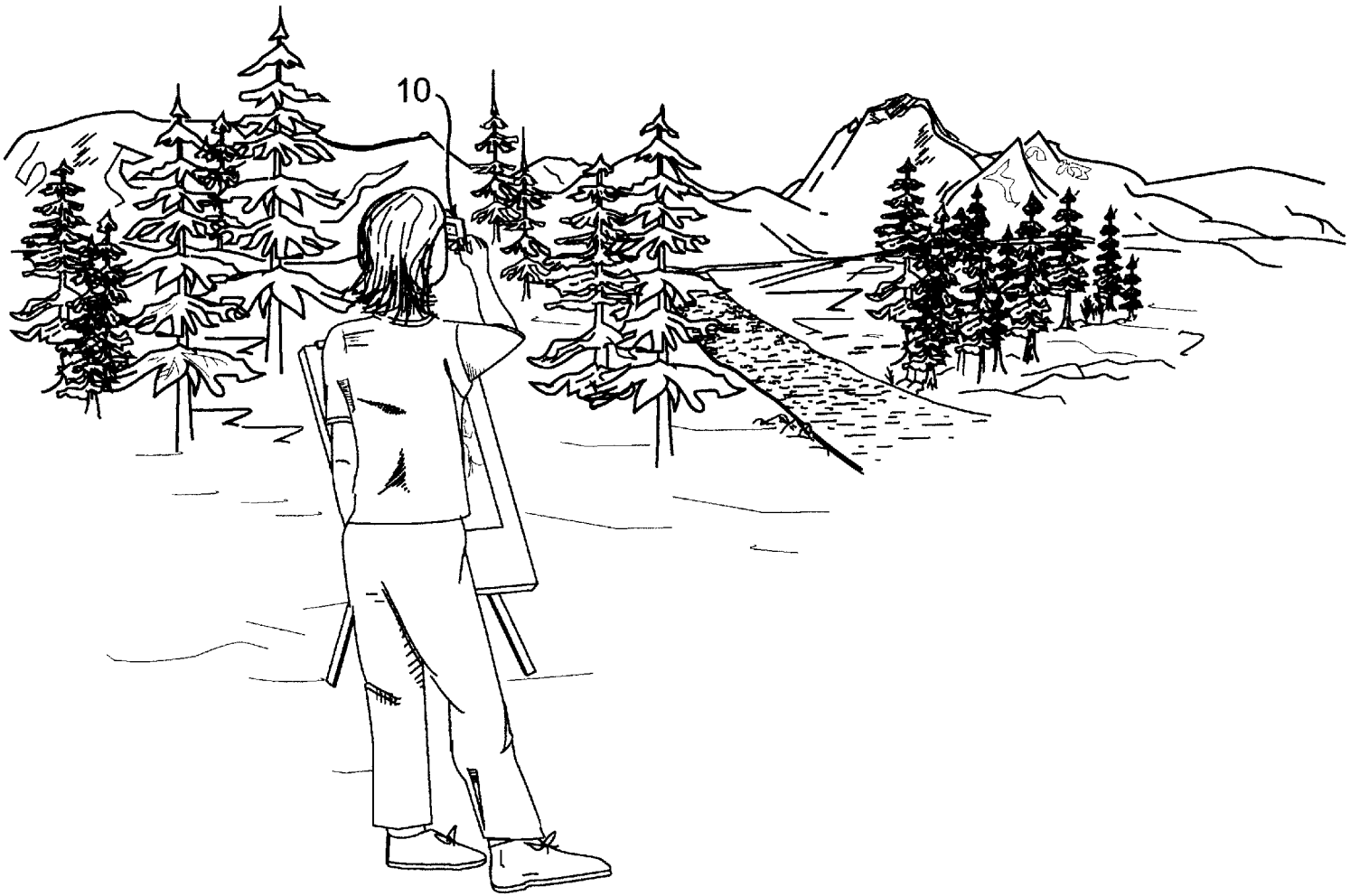
FIG. 1 illustrates use of the viewing frame by an artist in the field.

In FIG. 1 there is shown an artist viewing a landscape scene through the central opening in a viewing frame 10 of the invention. By moving the sliding opaque panel 14 relative to the frame 12, the size and the shape of the central opening 11 in the frame are changed. When the panel is moved only a short distance relative to the frame, the opening which is viewed is long and narrow. As the panel is moved further relative to the frame, the height of the viewed opening increases, and the shape of the opening changes.

Figure 2:
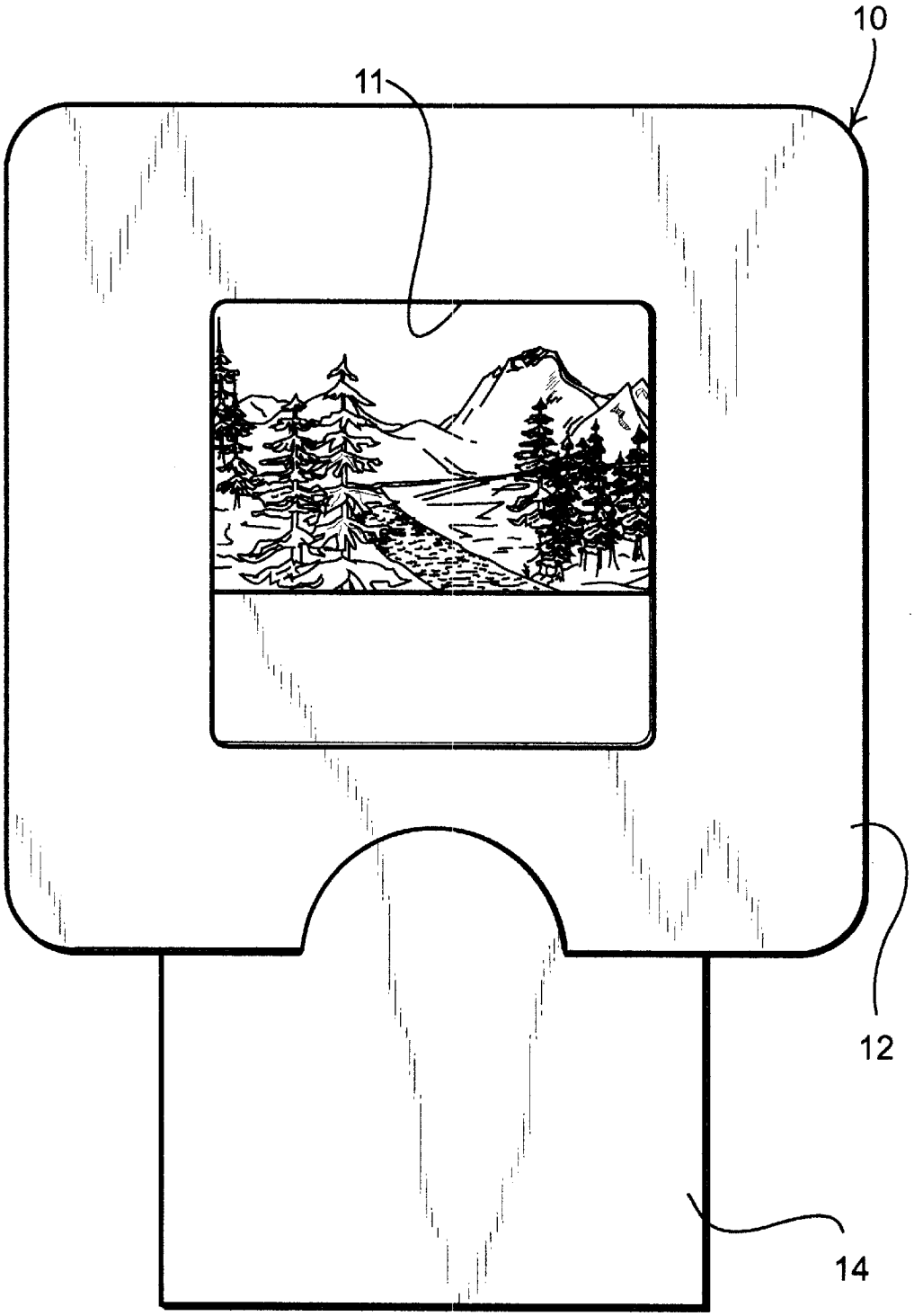
FIG. 2 illustrates one view of the subject landscape of FIG. 1 through the opening in the viewing frame.

FIG. 2 illustrates the landscape scene as viewed through the central opening 11 when the panel 14 is partially extended outwardly from the frame 12. By moving the panel further inwardly or outwardly relative to the frame, the size and shape of the viewed subject change. Also, by rotating the frame in one direction or the other, the appearance of the subject area which is being viewed also changes. Because the frame 12 and the panel 14 are each opaque, they effectively block out portions of the subject area which are not desired to be painted, sketched, etc. The frame is preferably square but it could be rectangular, if desired.

Figure 3:
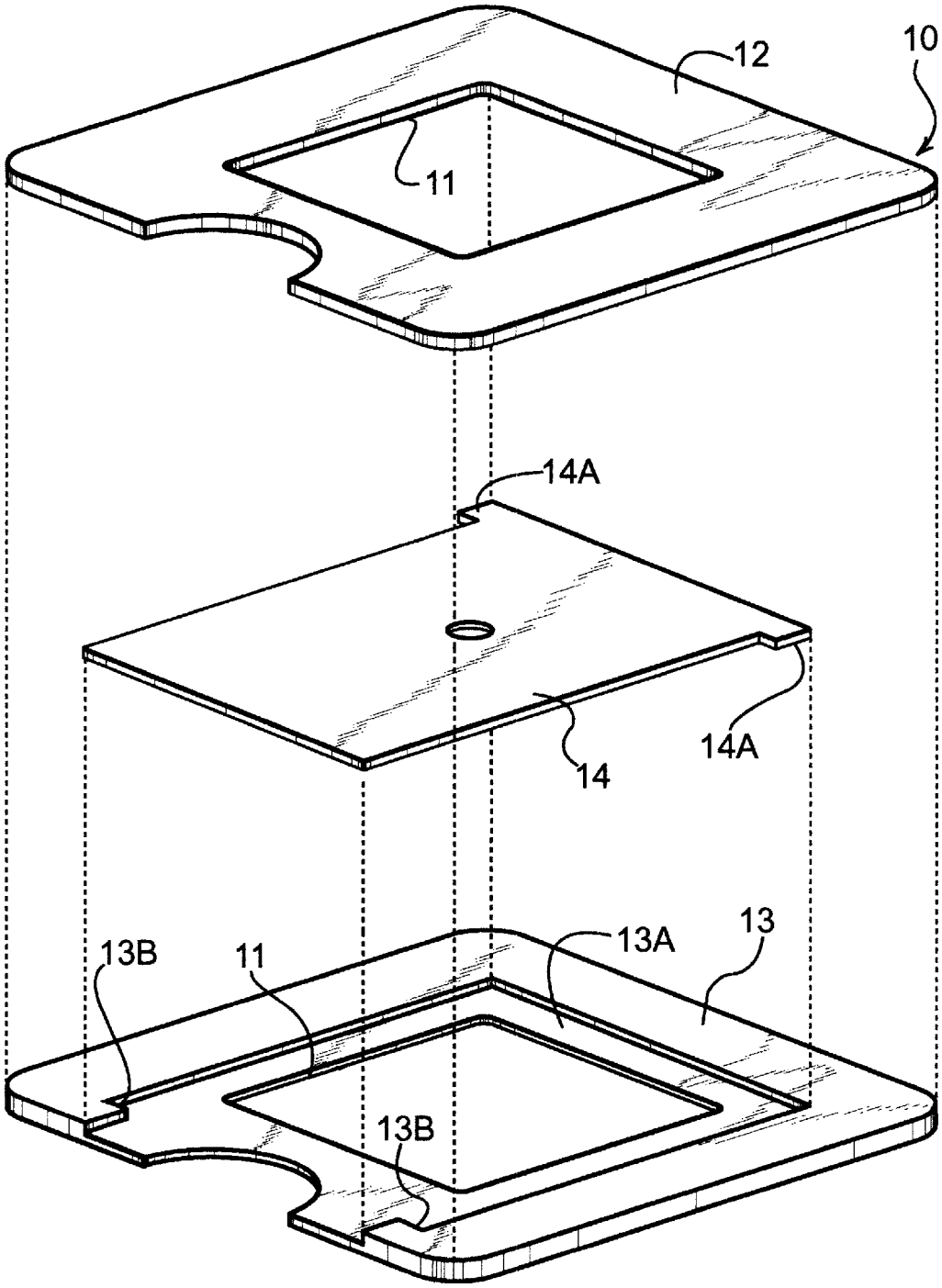
FIG. 3 is an exploded view of a preferred embodiment of a viewing frame of the invention.

FIG. 3 is an exploded view of one embodiment of a viewing frame 10 of the invention comprising an opaque upper frame section 12 having a square central opening 11 and an opaque lower frame section 13 having a similar central opening 11. The lower frame section includes a recessed area 13A in which the panel 14 is received. Shoulders 13B are located near one side of the frame section 13, as shown. The rear edge of the panel 14 includes ear members 14A, as shown.

After assembly of the frame sandwich, the panel 14 can be slidably moved inwardly and outwardly relative to the frame. The panel is prevented from being pulled out of the frame completely by means of the ear members 14A abutting the shoulders 13B.

Preferably the frame sections and the panel are composed of opaque medium gray plastic. The medium gray color enables the artist to best view both the dark and light colors of the subject without interference. Brightly colored or shiny frames are undesirable because they are distractive.

The size of the frame and the sliding panel may vary, e.g., from about 2 inches square to 6 inches square. Generally, a square central opening in the frame is preferred, although other shapes of openings could be used. As the panel is moved between its outward and inward positions, the shape of the viewed central opening 11 changes from a square to an infinite series of rectangles of different sizes.

The viewing frame can be made of water-repellant materials, oil-repellant materials, etc. and is compact and light in weight.

Figure 4:
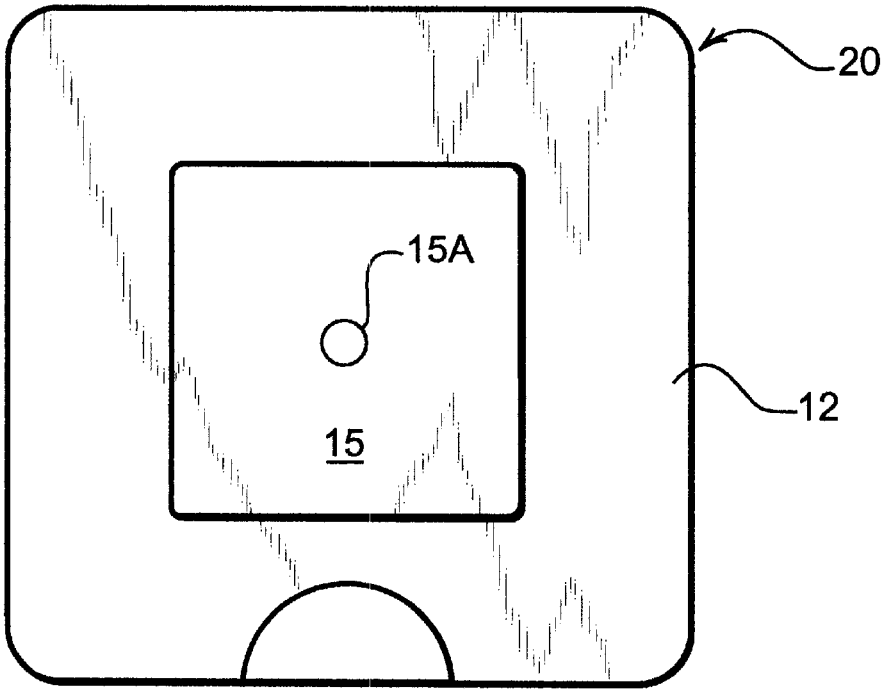
FIGS. 4 and 5 illustrate another embodiment of viewing frame of the invention.
Figure 5:
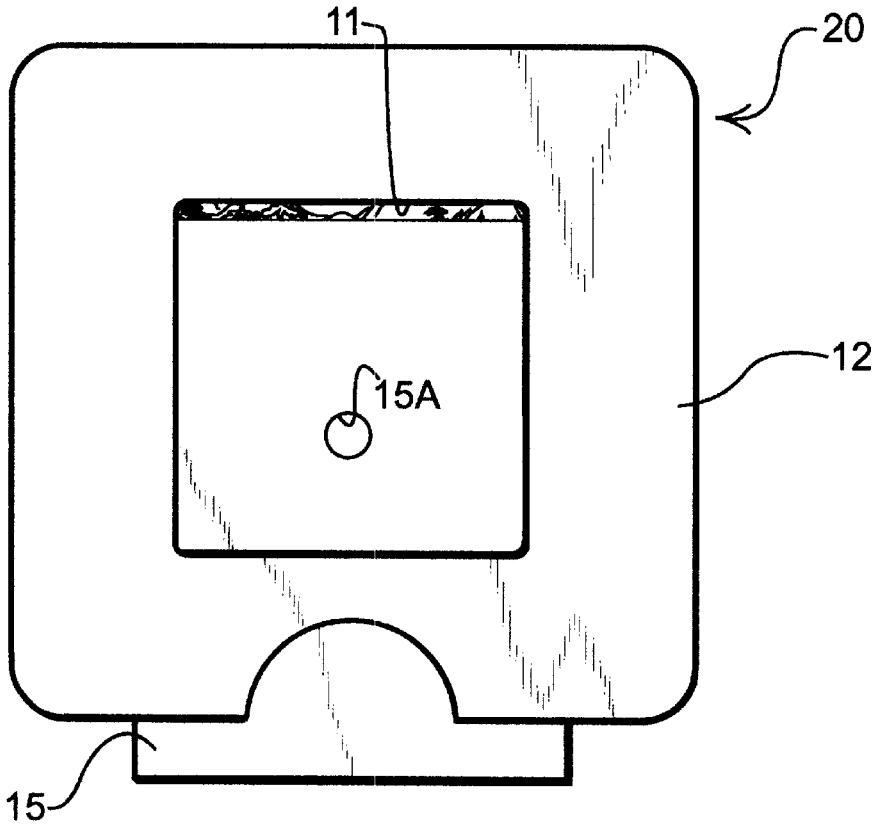

FIGS. 4 and 5 illustrate another embodiment of viewing frame 20 of the invention. In this embodiment the sliding panel 15 in frame 12 includes a small opening 15A which is useful for an artist to determine the value and color that he or she wants (e.g. for painting a particular subject). The shape of the opening 15A may be circular, square, rectangular, triangular, oval, octagonal, or any other desired shape. The diameter of the opening 15A is typically in the range of about 0.12 to 0.5 inch. Although it is preferred for the opening 15A to be centrally located in panel 15, it could be located anywhere on the panel or it could even be located in the frame 12 itself.

Other variants are possible without departing from the scope of this invention.

What is claimed is:

1. A compact viewing frame comprising:

(a) an opaque frame having a central opening therein;

(b) an opaque panel carried by said frame and being slidingly movable in a manner such that (i) when said panel is in an inward position, the central opening of said frame is blocked by said panel, (ii) when said panel is in a fully-outward position the central opening is completely open, and (iii) when said panel moves between its inward and outward positions the shape and size of the central opening changes; and wherein said panel further comprises (1) means for preventing said panel from being separated from said frame, and (2) a small opening therethrough having a diameter in the range of about 0.12 to 0.5 inch.

2. A viewing frame in accordance with claim 1, wherein said frame is square.

3. A viewing frame in accordance with claim 1, wherein said frame comprises a sandwich of two frame sections between which said panel is positioned.

4. A viewing frame in accordance with claim 1, wherein said frame is composed of medium gray plastic.

5. A viewing frame in accordance with claim 1, wherein said means for presenting includes ear members extending from said panel.

* * * * *